US005085277A

United States Patent [19]

Hopper

[11] Patent Number: 5,085,277

[45] Date of Patent: Feb. 4, 1992

[54] SUB-SEA WELL INJECTION SYSTEM

[75] Inventor: Hans P. Hopper, Aberdeen, Great Britain

[73] Assignee: The British Petroleum Company, p.l.c., London, England

[21] Appl. No.: 609,356

[22] Filed: Nov. 5, 1990

[30] Foreign Application Priority Data

Nov. 7, 1989 [GB] United Kingdom ..... 8925075

[51] Int. Cl.[5] ..... E21B 33/035

[52] U.S. Cl. ..... 166/341; 166/335; 405/128

[58] Field of Search ..... 405/53, 128, 210; 166/335, 341, 368, 339, 97.5, 344, 346, 351; 175/206, 207

[56] References Cited

U.S. PATENT DOCUMENTS

| | | | |
|---|---|---|---|
| 3,360,048 | 12/1967 | Watkins | 166/335 |
| 3,662,822 | 5/1972 | Wakefield, Jr. | 166/335 |
| 4,429,746 | 2/1984 | Allard | 405/128 |
| 4,632,188 | 12/1986 | Schuh et al. | 166/368 |
| 4,887,672 | 12/1989 | Hynes | 166/368 |
| 4,942,929 | 7/1990 | Malachosky et al. | 405/128 |
| 5,004,051 | 4/1991 | Rosendahl et al. | 175/206 |

*Primary Examiner*—Thuy M. Bui

*Attorney, Agent, or Firm*—Michael F. Esposito; Larry W. Evans

[57] ABSTRACT

A slurry of oil-impregnated cuttings from the use of oil based drilling mud and other unwanted slurries and fluids may be injected into the annulus of a sub-sea well and then into a porous formation through which the well has passed using apparatus on a guide base surrounding the sub-sea well head. The guide base comprises a coupling for a pipe extending down from the drilling rig, a one-way isolation valve and pipework leading to the outermost housing of the well. The outermost housing has ports to carry the slurry into the outermost annulus and inner housings may also have ports to carry this slurry into inner annuli. Inter housings also have a one-way check valve to control the injection. The guide base may have a cement circulation pipework and a cement and dump valve. The guide base may also be a retrievable base so that the injection apparatus may be reused.

12 Claims, 9 Drawing Sheets

SUB-SEA WELL INJECTION SYSTEM

This invention relates to an injection system for disposing of oil-impregnated cuttings recovered from oil based drilling muds in the form of a liquid slurry. The system can also be used for the disposal of other unwanted slurries or fluids resulting from drilling or other operations. It applies particularly to the drilling of sub-sea wells.

In recent years, the oil industry has been reverting to the use of oil-based muds (OBM) for drilling wells, instead of water based muds. The advantages of oil-based muds over water-based muds are:

(i) that they improve well bore stability by minimising drilling fluid effects on certain formations, (ii) that they improve drill bit performance through efficient removal of cuttings and better lubrication of the drill bit surfaces, (iii) that they reduce drill string torque.

The problem of using OBM is the disposal of the mud slurry and the oil-impregnated cuttings. The problem is accentuated when drilling sub-sea wells. At present, when drilling offshore wells, the cuttings are separated from the mud, drained, and dumped on the sea bed. Some countries require the cuttings to be washed with a surfactant before dumping. The OBM itself, separated from the cuttings, is recycled and re-used, being topped up and maintained in quality as necessary. On completion of a well the OBM (if not left in the sealed hole) is shipped ashore, treated and re-used for another well.

The objection to dumping cuttings on the sea bed is that they are impregnated with oil. Even surfactant-washed cuttings have only had their surface oil removed. The oil can seep out affecting the sea-bed environment, particularly if large quantities of cuttings are dumped over a small area as may be the case around multi-well platforms or sub-sea templates.

One solution is not to dump the cuttings onto the sea bed tut to inject them into the annulus of a well. If the cuttings are ground and suspended in a suitable liquid (e.g. surplus oil or chemically treated water) to form a pumpable slurry, then the slurry can be injected through a well annulus into one of the non-oil producing porous formations through which the well has been drilled.

There may be other unwanted fluids or slurries from drilling or other operations which cannot be safely disposed of by dumping into the sea or onto the seabed. Such other fluids or slurries could also be disposed of in the same way.

Wells are formed from a series of casing strings of decreasing diameter (e.g. 30 inch, 20 inch, 13⅜ inch and 9⅝ inch) which are set, in sequence, as drilling proceeds,. Each smaller diameter casing extends further down into the hole. Finally a 7 inch pipe may be set extending down to the oil producing formation.

It would be theoretically possible to inject the slurry of ground oil impregnated cuttings into any of the annuli between the casings (e.g. into the 30–20 inch annulus, the 20–13⅜ inch annulus, or the 13⅜–9⅝ inch annulus). However it is normal to have two isolation barriers between the well itself and the lower pressure environment and formation. This may make injection into the 13⅜–9⅝ inch annulus inadvisable. Injecting into the outermost 30–20 inch annulus would be easier but the chance of these smaller length casings penetrating a suitable porous formation is less. Further the formation would bs too near the surface. The annulus most likely to be suitable for injection is thus the 20–13⅜ inch annulus, but it is to be understood that the invention could be used to inject the cuttings slurry into any appropriate annulus.

U.S. Pat. No. 4,632,188 describes apparatus for injecting waste materials into an annulus of a sub-sea well using a conduit and a remotely operably flow control valve.

The present invention is concerned with an injection system located on a guide base surrounding a well head so that the difficulties of modifying a well head to take injection lines is obviated.

According to the present invention apparatus for injecting unwanted slurries or fluids resulting from drilling or other operations into a sub-sea well through a drilling guide base positioned on an underwater surface comprises:

pipework on the guide base leading to a port in the housing supporting the outermost casing of the well, a fail safe isolation valve on the guide bass joined to the pipework, a coupling on the guide base joined to the fail safe isolation valve to which a line from a surface vessel or platform can be attached, said line, coupling, isolation valve and pipework forming a pathway through which an unwanted slurry or fluid can be passed from a surface vessel or platform into an annulus of the well without modification of the well head housing proper.

By the term "without modification of the well head housing proper", we mean that no pipe work is required on the well head and no modification of the sealing and locking mechanisms for the well head housing. The only modifications required are ports in the lower portions of some of the housings.

The line from the surface vessel or platform may be a flexible line and the coupling may be a swivel coupling. Alternatively the line may be a rigid line extending down a riser from the surface vessel or platform to a BOP package, e.g. an additional line parallel to conventional kill or choke lines. The BOP package may then have a stab connection to the coupling on the guide base so that the line is connected as the BOP package is landed on the guide base.

The flexible line and swivel coupling may be useful when drilling single wells. For multiple drillings the more robust line going via the BOP package may be the preferred option.

The above system will direct the slurry or fluid to the outermost annulus of the well. If it is desired to direct the slurry or fluid to the next inner annulus then a port will be required in the housing supporting the next casing and so on, with ports in all housings outside of the desired annulus of injection.

The ports in the inner housings desirably have one-way check valves in them allowing injection inwards, but preventing ejection outwards. No pipe work will be required connecting the ports.

The one-way check valves may comprise a cylinder with ports and a cylindrical sleeve with ports sliding within the cylinder.

Since the one-way check valves will be controlling a potentially abrasive slurry of drill cuttings, they may be designed with ports and seals such that, when closing the valves the flow of slurry is cut off before any of the seals have to cross the ports.

Well head housings for casings normally have pressure seals to pressure isolate the well. The casings themselves also provide mechanical pressure isolation barrier between the well and the pressure environment of the formations that are being drilled through. When drilling through high pressure formations it is recommended that there are two casing strings to provide pressure isolation barriers. The same precaution is considered advisable when injecting slurry according to the present invention.

With the system of the present invention no major modifications to the wellhead housing are required. No pipes or conduits have to be added to the well head proper which could interfere with the sealing of the housings and introduce possible areas of weakness in the pressure isolation of the well.

The system of the present invention can be used with any type of guide base whether permanent or retrievable. It is, however, particularly suitable for use with retrievable guide bases since the valves, couplings and, possibly, the pipework can be recovered with the guide base and not left adjacent to the well head.

A preferred type of retrievable guide base is that described in UK Patent Application No 2228508-A corresponding to U.S. Ser. No. 483,484 now U.S. Pat. No. 5,005,650. The guide base is in two parts, an annular inner portion fitting around a conductor housing and fixed to it, and a retrievable outer portion releasably locked to the annular portion.

The pipework leading to the port in the housing of the outermost casing may be in the annular portion (which for the purposes of the present invention is to be considered as part of the guide base). The fail safe isolation valve may bs on the retrievable portion, in which case, there may be a releasable connection between the pipework and the isolation valve.

The slurry injection system may be combined with a cement circulation system having pipework and a dump valve so that cementing of the various casings can also be carried out. Depending on the casing being cemented, the cement stinger running tool may have an isolation sleeve on it to prevent the cement getting into and damaging the slurry injection system, including any check valves between casing housings.

Protection of the slurry injection system by other forms of temporary isolation sleeves may also be desirable at other stages of well drilling and testing sequence prior to the setting of the casing outside of which the slurry is to be injected.

The invention, is illustrated with reference to the accompanying drawings, in which FIG. 1 is a schematic representation of a sub-sea well equipped for slurry injection according to the present invention.

Figure 1:
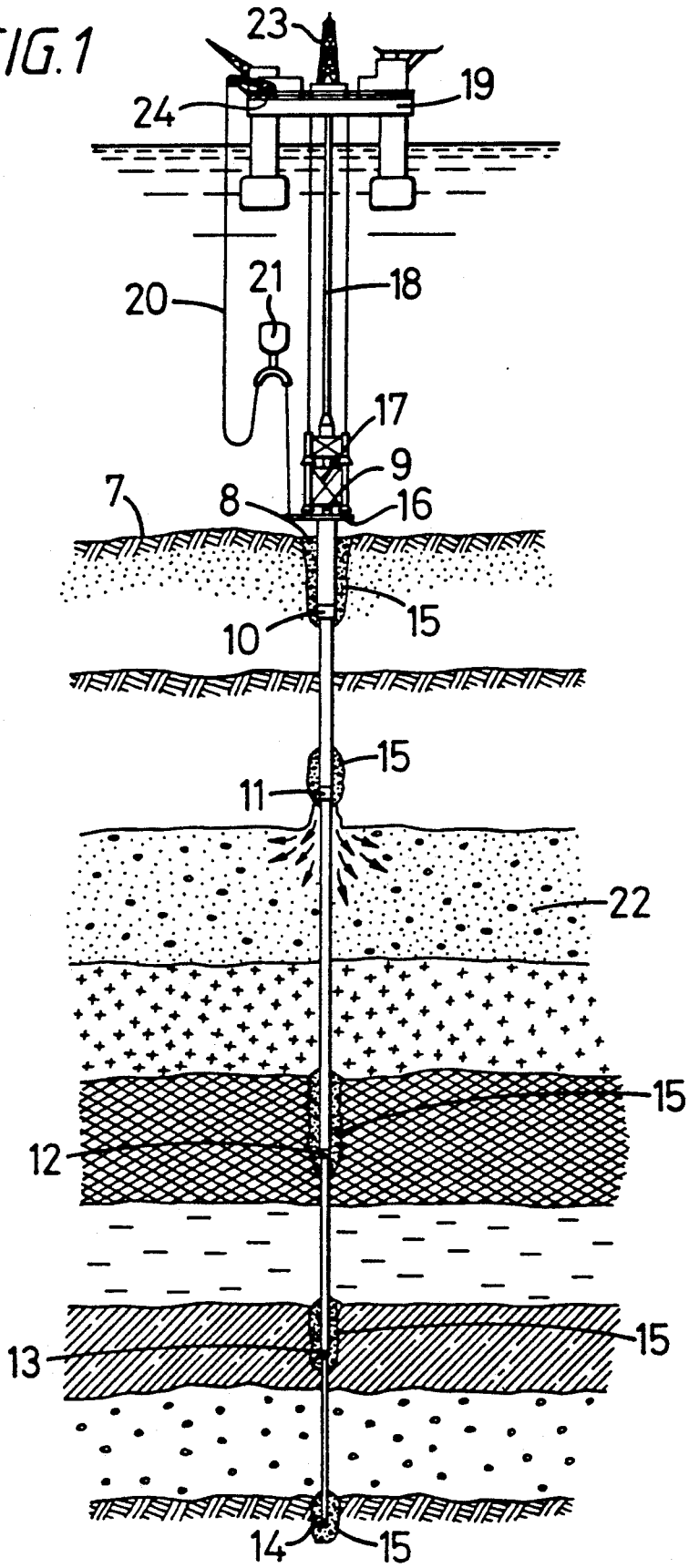

FIG. 1 shows a sea bed 7 with water above and a series of formations below. Well 8 has been drilled into the sea bed and a series of casings set and cemented. Each casing is of narrower diameter and extends further into the formations. Thus from the well head 9 is the 30 inch conductor casing 10, with a shoe at its end, then 20 inch casing and shoe 11, then 13⅜ inch casing and shoe 12, then 9⅝ inch casing and shoe 13 and finally 7 inch well bore liner with its shoe 14.

Cement is indicated at 15 from which it will be seen that conductor casing 10 has been fully cemented into the formation, but that casings 11, 12, 13 and liner 14 have been cemented only at their ends.

The well 8 has therefore, a series of annuli of increasing length between the casings. The outermost annulus between casings 10 and 11 has, however, been filled with cement 15 and does not provide a path down into the formations.

Well head 9 is surrounded by a retrievable guide base 16. BOP stack 17 is positioned on well head 9. Riser 18 extends up to semi-submersible drilling rig 19 having derrick 23, and reel handling frame 24 for flexible line 20. Flexible line 20 supported by float 21 runs down from rig 19 to guide base 16 to feed a slurry of oil-based drilling mud cuttings into the well. In FIG. 1 the injection is into the annulus between the 20 inch and 13⅜ inch casings 11 and 12 with arrows indicating how the slurry can be forced down the annulus and into porous formation 22 below the end of the 20 inch casing 11.

In FIG. 1, the annulus between casings 12 and 13 and the annulus between casing 13 and liner 14 are shown as empty of cement, the casings and liner being cemented at their ends only. However, depending on the well design, any annulus not required for slurry injection can be cemented if desired.

Figure 2:
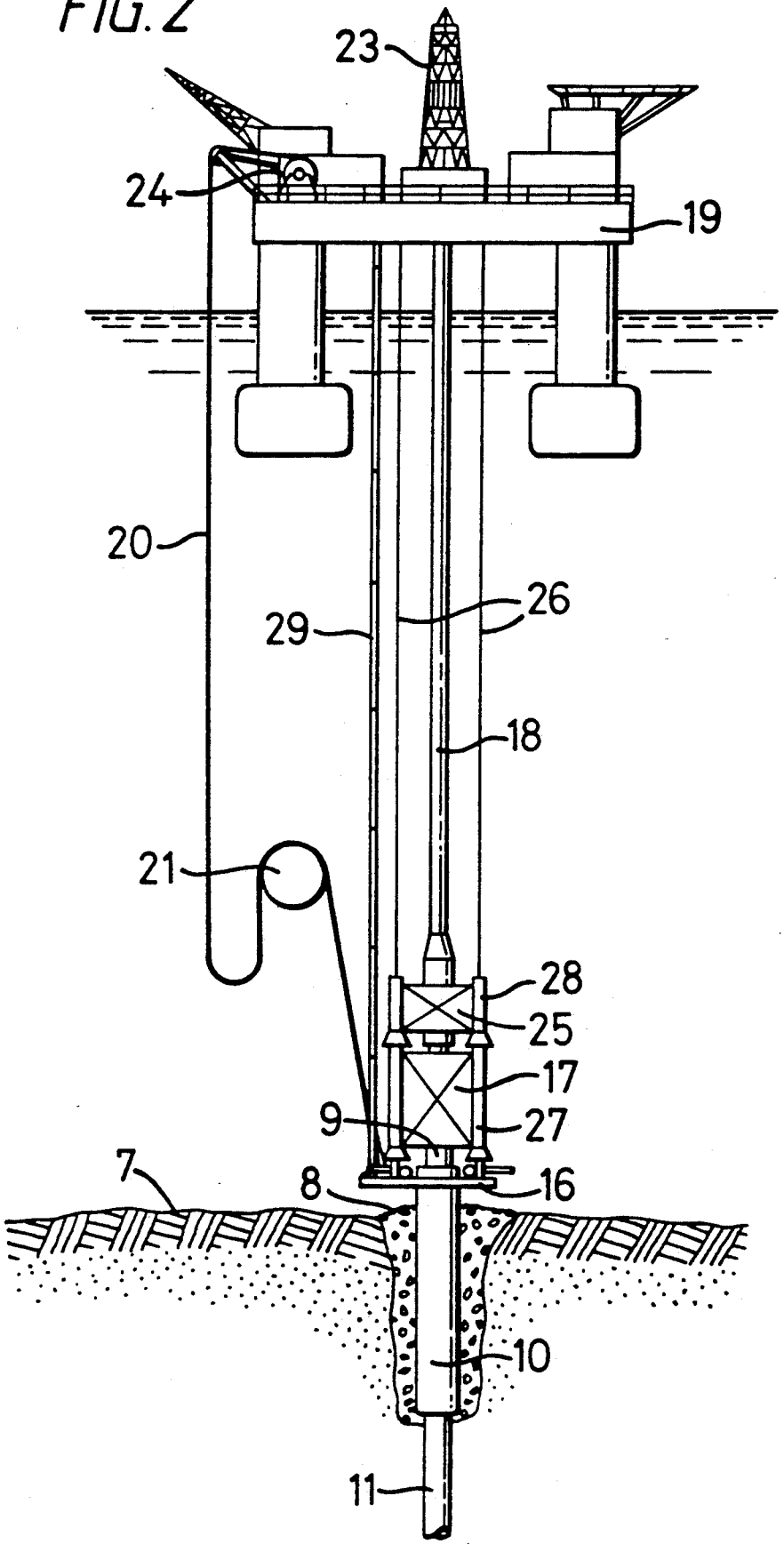
FIG. 2 is an enlarged representation of the well head and surface vessel of FIG. 1.

FIG. 2 gives more details of the units above sea bed 7

At the sub-sea surface 7, FIG. 2 illustrates the situation at the point where 20 inch casing 11 suspended from 18¾ inch well head housing has been placed within 30 inch conductor casing 10. BOP stack 17 has a lower marine riser package 25 above it connected to riser 18.

Guidelines 26 extend up to rig 19 from the retrievable guide base 16. Stack 17 and riser package 25 are located, in conventional manner, by guide sleeves 27 and 28 fitting over guide posts. Control umbilical 29 also extends from rig 19 to guide base 16.

Retrievable guide base 16 is of the type described in UK Patent Application No 2228508-A corresponding to U.S. Ser. No. 483,484 now U.S. Pat. No. 5,005,650 and is shown in more detail in FIG. 3. Retrievable guide base 16 is formed of an inner annular portion 30 and an outer retrievable portion 42. On the retrievable portion 42 of guide base 16 is shown dump valve 31 for a cement circulating system and, for the slurry injection system, isolation valve 32 and pipework 33 leading to a swivel coupling 34 to which flexible line 20 is attached. It will be noted that swivel coupling 34 is at the outer edge of guide base 16 so that flexible line 20 is kept well clear of the well head.

Figure 3:
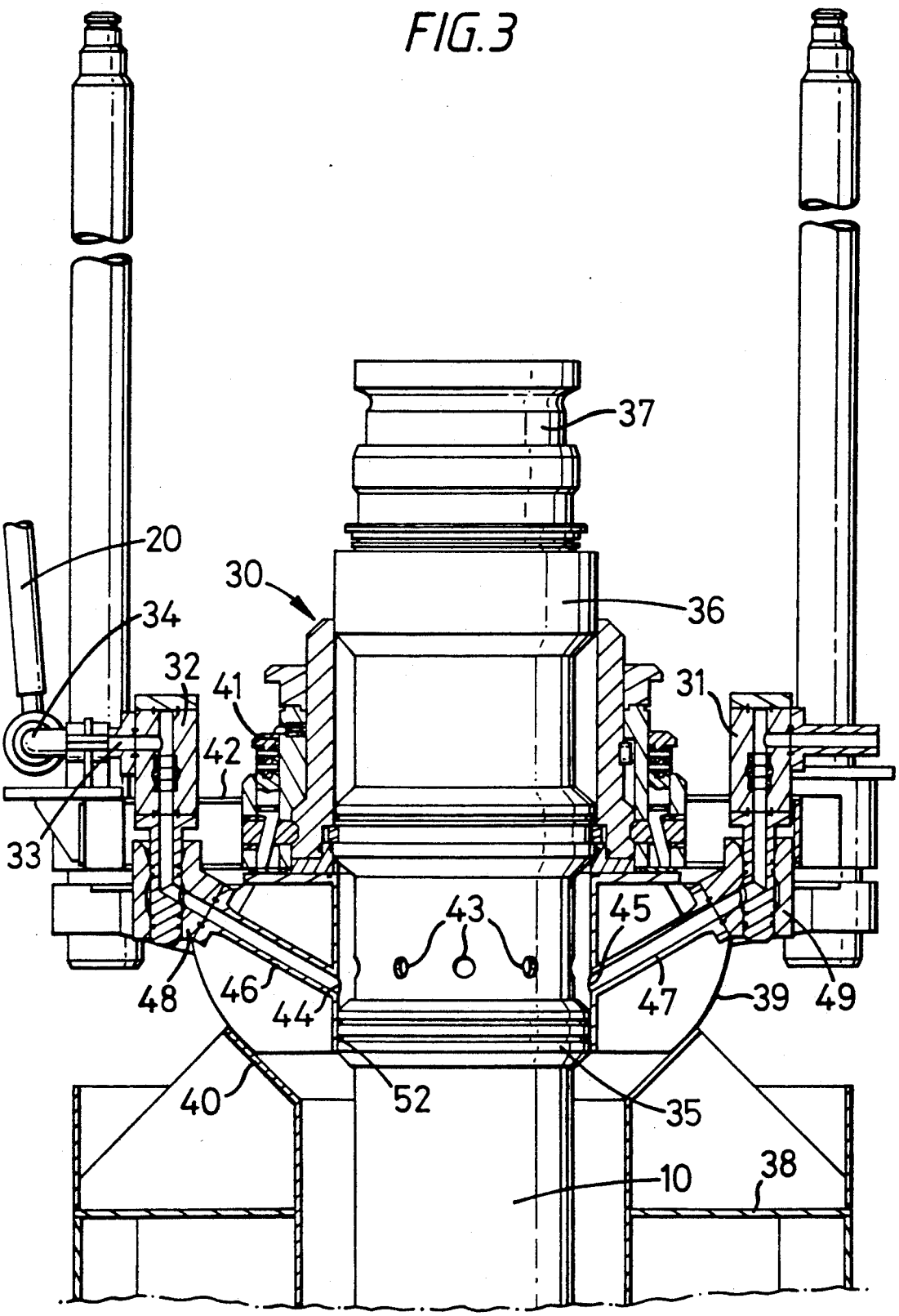
FIG. 3 is a partially sectioned side view of a well head and guide bass with a slurry injection system according to the present invention.

FIG. 3 shows 30 inch conductor casing 10 with support clamp 35 which is attached to conductor housing 36. Landed within this is a conventional universal well head lock down hub 37.

Guide base 16 seats on mud mat 38, curved profiled plates 39 of the guide base resting in funnel 40 of the mud mat. This arrangement acts as a sort of gimbal or universal joint so that the guide base can remain horizontal even on a sloping sea bed. Plates 39 form part of an inner annular portion 30 of the guide base which is fixed to conductor housing 36. Surrounding inner portion 30 is an outer retrievable portion 42 latched to the inner portion by latches with vertical latch releases 41.

Conductor housing 36 has a series of ports 43 in it. At the same level are ports 44, 45 in the inner portion 30 of the guide base with pipes 46, 47 leading to receptacles 48, 49. Slurry injection valve 32 terminates in a stab mating inside receptacle 48 and cement dump valve 31 terminates in another stab mating inside receptacle 49. Receptacles 48 and 49 are on the inner annular portion 30 of the guide base and valves 32 and 31 on the retrievable guide base portion 42. The stabs and receptacles thus provide readily mateable and releasable connections as between the retrievable guide base portion 42 and fixed annular portion 30.

Slurry injection isolation valve 32 allowing injection into pipe 48 may be a horizontally mounted fail-safe gate valve which fails safe closed. The inlet to valve 32 is down flexible pipe 20 from the drilling rig and through swivel coupling 34 and pipe 33. Cement dump valve 31 may be any convenient "fail-as-is" valve. Both valves may be hydraulically operated with umbilical 29, shown in FIG. 2, providing the hydraulic power supply for them. Both valves may also have manual over-rides (not shown) capable of being operated by an ROV.

Support clamp 35 has a ring seal 52 where it contacts inner portion 30 of the guide base. This provides a seal below ports 44, 45. Conductor housing 36 is also sealed with respect to inner guide bass portion 30 above ports 44, 45. Thus slurry injected down pipe 46 through port 44 can only pass through ports 43 in housing 36 into the inside of 30 inch conductor housing 10. Similarly cement being circulated up the inside of 30 inch conductor 10 can only exit through ports 43 and then through port 45 and pipe 47 to cement dump valve 31.

FIGS. 1, 2 and 3 show a flexible line 20 for the slurry from the drilling rig to a swivel coupling 34 on the guide base. Instead of this a rigid line could be used down a riser and across a BOP package to the guide base. With this type of line the swivel coupling can be replaced by a female receptacle similar to receptacles 48 and 49. Such a receptacle is shown at 50 in FIG. 5. The BOP package will have a stab for mating with receptacle 50 and a modified BOP package is shown in FIG. 4.

Figure 4:
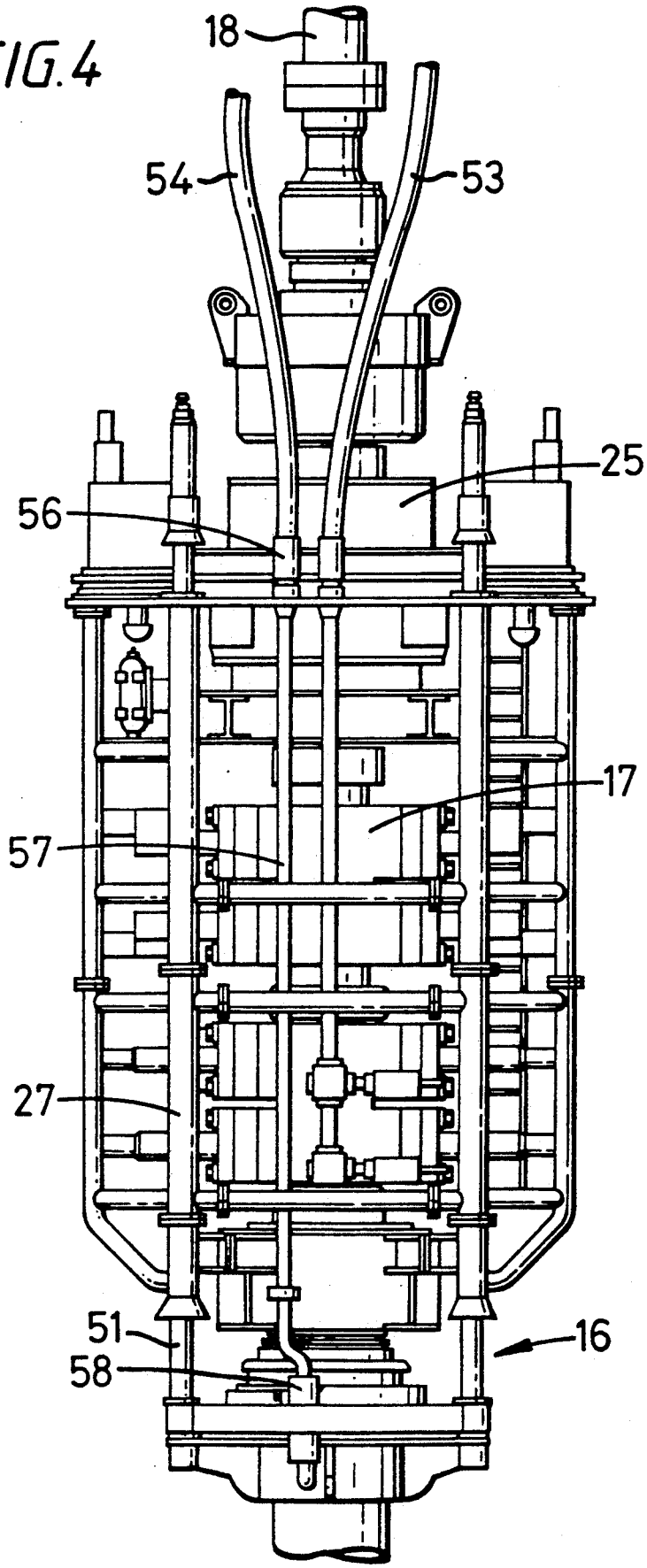
FIG. 4 is a side view of a BOP package modified for use with the of FIG. 5.

In FIG. 4 riser 18, lower marine riser package 25 and BOP package 17 are shown resting on drilling guide base 16. The riser, riser package and BOP package may be of conventional design and need not be described in detail. The BOP package is located by guide sleeves 27 on guide posts 51 of guide base 16. A kill and choke line 53, also conventional, is shown. There may be two such lines, the other line being the other side of the riser and hence not shown. These lines come down the riser and are taken by flexible portions of line across the riser package 25 to the BOP package 17.

The additional feature of FIG. 4 relevant to the present invention is a third line 54 parallel to choke and kill line 53 coming down the riser and across the riser package 25 to connector 56 at the top of BOP package 17. Pipe 57 from connector 56 extends vertically down BOP package 17 and beyond its end to a stab 58 positioned to mate with slurry injection line receptacle 50 (FIG. 5) on guide base 16.

Figure 5:
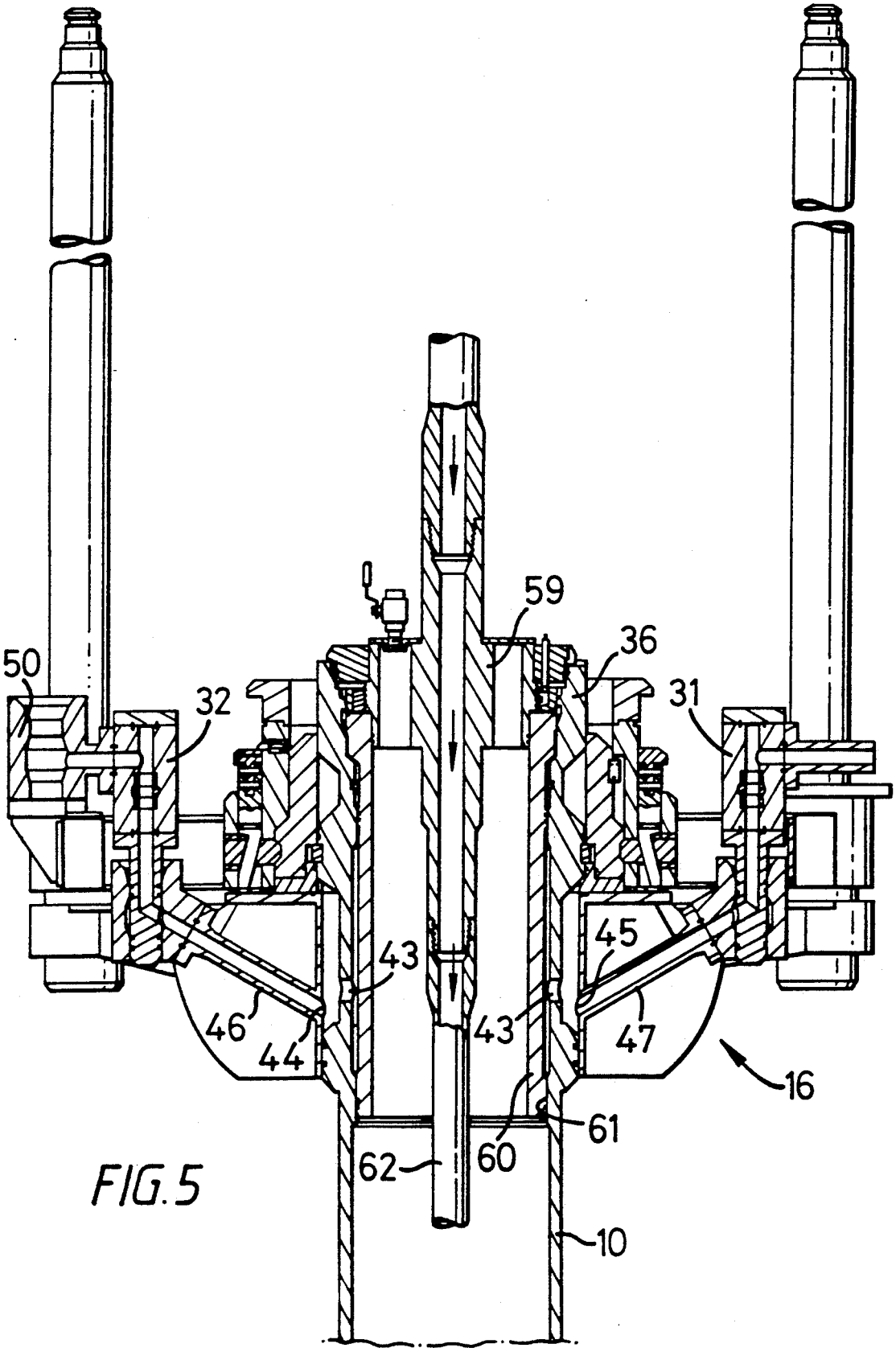
FIG. 5 shows a well head at the conductor casing cementing stage.

FIG. 5 shows the initial stage of running and landing the retrievable guide base 16, conductor housing 36 and conductor casing 10 as a unit using a running and cementing tool 59. Although not shown in FIG. 5, the unit may be run on guide wires (26 of FIG. 2) to seat onto a mud mat (38 of FIG. 3).

The unit is run with cement dump valve 31 open until the unit is below the sea surface to allow air to escape. Then it is closed by a trigger line. FIG. 5 shows a guide base with female receptacle 50 designed to take a slurry injection line coming from a BOP package. It is, therefore, shown empty at this initial running stage. If the guide bass uses a swivel coupling (34 of FIG. 3), then the flexible line from the drilling rig is attached at this stage and is paid out from the rig as the unit is run.

The running and landing sequence and the units involved follow conventional practice. Further details, if required, can be obtained from UK Patent Application No 2228508-A corresponding to U.S. Ser. No. 483,484 now U.S. Pat. No. 5,005,650.

Running and cementing tool 59 fits inside conductor housing 36 and the variation of relevance to the present invention is that it has, depending from it, an isolation sleeve 60 with ring seals 61 at its bottom so that ports 43 of housing 36 are sealed from the interior of casing 10.

After landing, casing 10 is cemented in normal fashion, cement being pumped down stinger 62 of tool 59 to the bottom of casing 10 and so out and up the outside of it to cement the casing into the sea bed.

Isolation sleeve 60 and seal 61 prevent any adventitious matter getting into the slurry injection system or the cement dumping system during any of the running, landing or cementing sequences.

Figure 6:
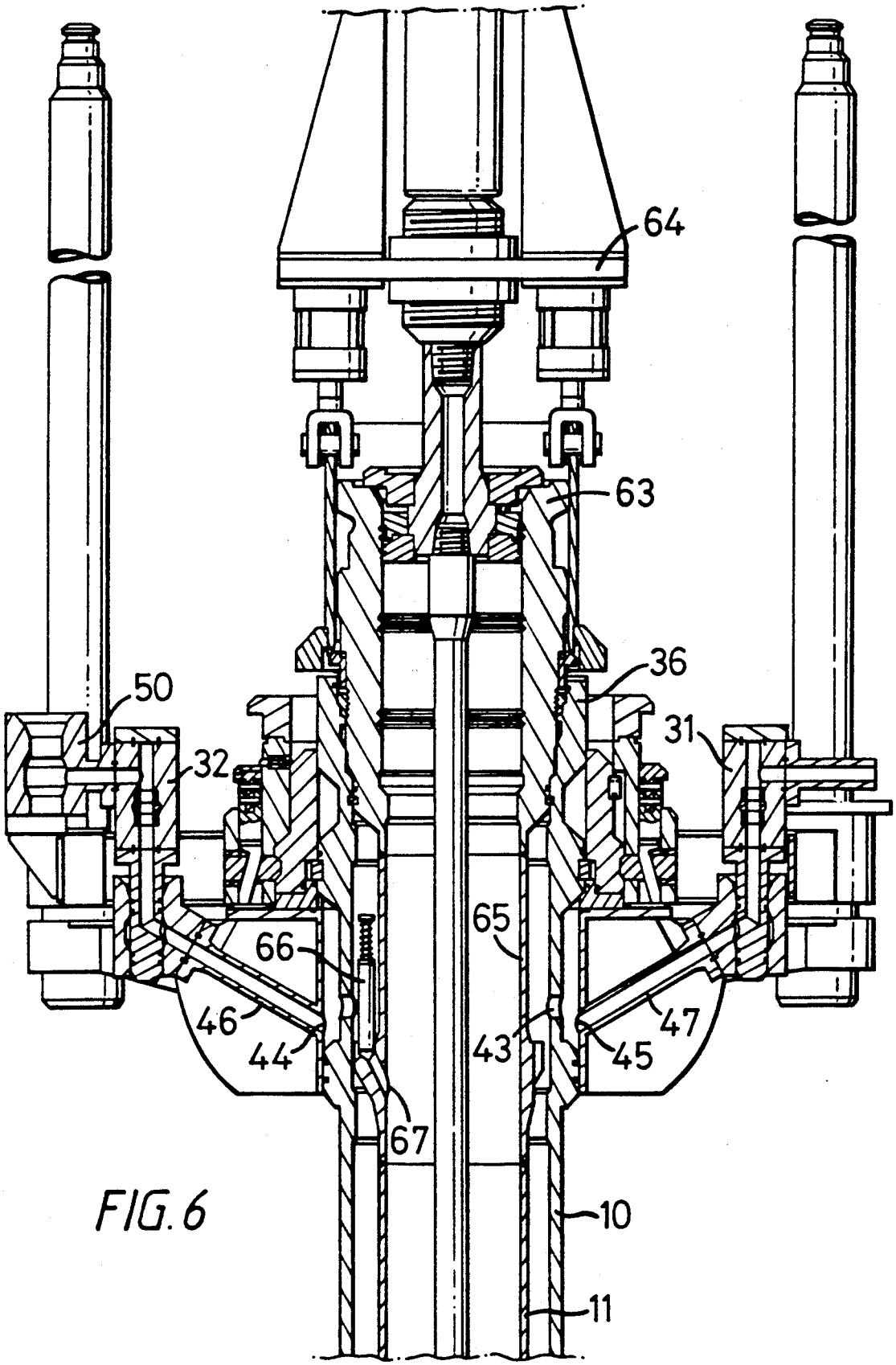
FIG. 6 shows the placement of 20 inch casing and an 18¾ inch well head.

Further drilling can now proceed until sufficient footage has been drilled to allow the placement of an 18¾ inch well head housing 63 in the conductor housing 36, housing 63 supporting 20 inch casing 11. This stage is shown in FIG. 6, housing 63 being run on running tool 64.

18¾ inch well head housing 63 has a conventional top portion but has at its bottom an extension 65 between the housing proper and 20 inch casing 11. Extension 65 has a number of check valves 66 on its outside leading to a port 67. Only one of each is shown in FIG. 6. Check valve 66 is pressure operated and when open provides a passage from the outside to the inside of 20 inch casing 11. Check valve 66 is at the level of ports 43 in 30 inch conductor housing 10, which in their turn, are at the level of port 44 of the slurry injection system. Check valve 66 and port 67 thus provide a passage for injected slurry into the inside of 20 inch casing 11, provided the injection pressure is strong enough to open check valve 66.

However this pathway for slurry injection is not used at this stage. Once 18¾ inch housing 63 and 20 inch casing 11 have been set, casing 11 can be cemented using a tail pipe stinger. Cement pumped down the inside of casing 11 can return up the annulus between casings 11 and 10, through port 43 in conductor housing 36 and then through port 45, pipe 47 and dump valve 31 of the cement dumping system. The tail pipe stinger injects cement inside casing 11 well below the level of port 67 and check valve 66 of the slurry injection system so that there is no risk of these being blocked by the cementing operation.

Conductor housing 36 and 18¾ inch housing 63 will have the usual seals to make them pressure tight so no cement can penetrate the well head proper. Slurry injection valve 32 will also be closed preventing egress through this way. When the cementing operation has been concluded a flush of sea water can be sent down the slurry injection system through valve 32, around the well-head and out through the dump valve 31 to eliminate any traces of cement from the well head, ports and valves.

If the slurry injection system uses a flexible line 20 (FIG. 2) the flushing can bs done immediately after cementing. If the system uses a rigid line across a BOP package, then drill pipe may bs run and stabbed into receptacle 50. Alternatively a stab and pipework may be linked with the well head running tool 64 used for the cementing to allow for flushing immediately after cementing.

When the cementing and flushing operation have been completed, dump valve 31 is closed and the running and cementing tool drawn up Port 67 and check valve 66 allow access into the inside of 20 inch casing 11, although, as explained hereafter, temporary bore protection sleeves may be used to block port 67 for testing or for some of the further drilling.

Now an 18¾ inch BOP stack can be run to allow further drilling followed by placement of the next 13⅜ inch hanger and casing.

Once the 18¾ inch BOP stack has been landed and before further drilling, the BOP connection can be tested using an isolation test tool which isolates the area below the well head including port 67. After testing the tool is removed. Now the slurry injection system and its valves can be tested. The check valve 66 can be tested first down through the BOP, monitoring any leaks up the slurry injection pipe. Prior to the next drilling, which will be of 17½ inch hole, an isolation sleeve is run to block port 67. Pressure down the slurry injection pipe which can be monitored up the choke or kill lines on the BOP will test the general pressure integrity of the system including that of the isolation sleeve (if used) and the cement filling of the 30 inch - 20 inch annulus between casings 10 and 11.

Once the system has been fully pressure tested further drilling can proceed and a 13⅜ inch hanger and casing placed according to standard practice. The isolation sleeve is removed, the double pressure integrity now relying on the flow valve of the slurry injection system and the cement filling between the 30 and 20 inch casings. Both of these have been fully tested.

Figure 7:
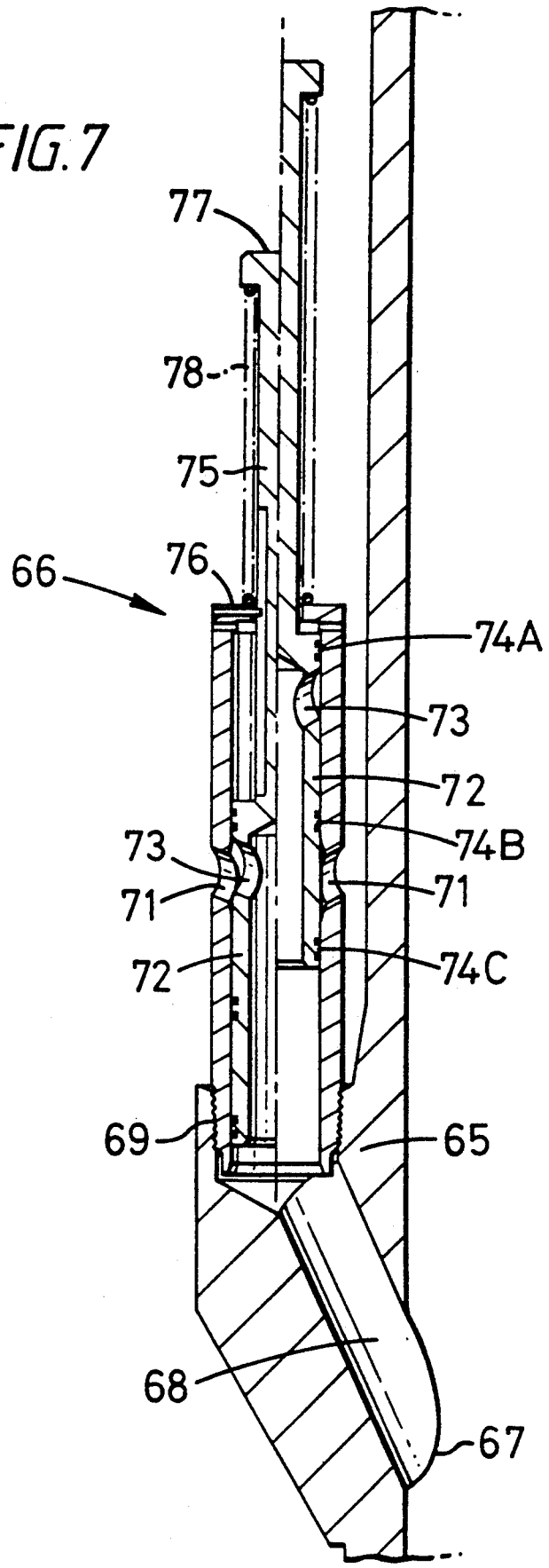
FIG. 7 is an enlargement of the check valve shown in FIG. 6.

FIG. 7 is an enlargement of check valve 66 of FIG. 6 Sleeve extension 65 of the 18¾ well head housing (63 of FIG. 6) is shown with port 67 on its inside and passage 68 leading up to check valve 66 screw threaded at 69 into an enlargement of extension 65.

FIG. 7 is illustrative showing the left hand side of check valve 66 in its open Position and the right hand side in its closed position.

Check valve 66 is formed of a cylinder 70 with ports 71 midway along the cylinder, and a hollow cylindrical slide 72 within cylinder with ports 73. Slide 72 fits closely within the cylinder and is sealed by three sets of double, chemical resistant seals 74A, B and C. Slide 72 is, however, open at its bottom.

Piston 75 of slide 72 extends through the and 76 of cylinder 70 and terminates in head 77. Spring 78 surrounds piston 75 tending to keep slide 72 in its upper closed position. Fluid pressure on the top of head 77 greater than the force of spring 78, any frictional forces and the fluid pressure below valve 66 will, however, automatically bring ports 71 and 73 opposite each other, allowing fluid on the right hand side of extension 65 to pass through ports 71 and 73, down inside sleeve 72 and then through passage 68 and port 69 to the left hand side of extension 65.

Check valve 66 will have to handle potentially abrasive slurries of drilling mud particles and is designed with a metal friction fit across the ports 71 and 73. It will be noted that although middle seals 74B have to cross ports 71 when slide 72 moves from the open to the closed position, ports 73 will move above ports 71 stopping the flow before this happens. The seals 74B thus cross ports 71 in a static flow regime. All the seals 74 A, B and C are thereby protected from the abrasive fluids.

The size of the ports in the valve, and passage 68 and port 67 in extension 65 are designed so that there is a pressure drop through the valve when open, thereby helping to eliminate flutter.

Figure 8:
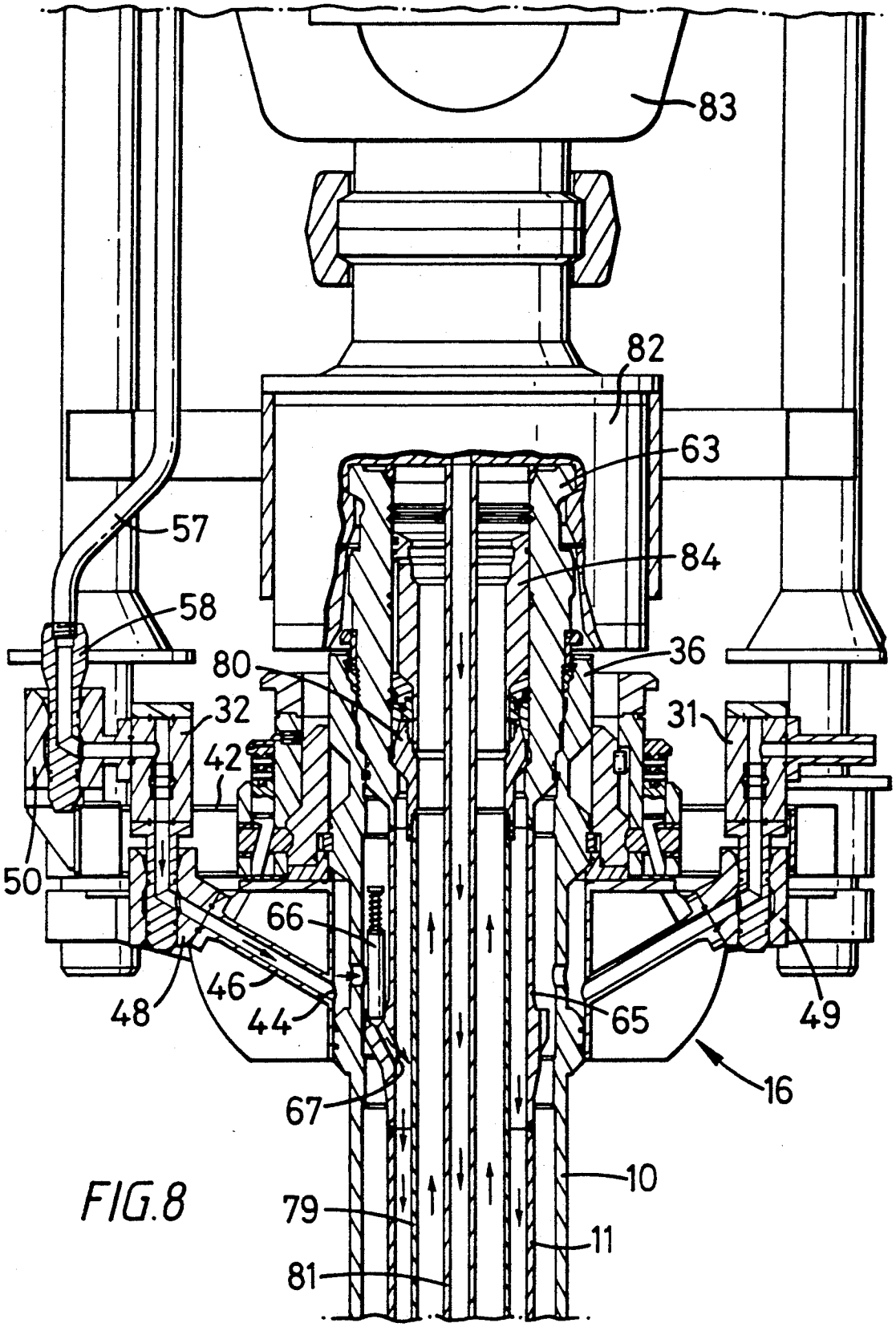
FIG. 8 is a partially sectioned view of a well head, guide base and slurry injection system during drilling preparatory to setting 9⅝ inch casing.

FIG. 8 shows a section through one side of a well head with a 13⅜ inch hanger in place.

FIG. 8 shows all the features of FIG. 6 for which the same reference numerals are used, plus 13⅜ inch casing 79 within 20 inch casing 11 suspended from 18¾ well head housing 63. Within 13⅜ inch casing 79 there is hollow drill string 81, drilling and deepening the well for the 9⅝ inch casing. FIG. 8 is partly diagrammatic and only partly sectioned. It will be appreciated that drill string 81 will extend up through drilling connector 82 and drilling BOP 83 to the drilling rig.

Also shown in FIG. 8 is bore protector 84 within 18¾ well head housing 63, slurry injection line 57 on BOP package 71 and stab 58 at the end of line 57 fitting into female receptacle 50 of the slurry injection system on retrievable portion 42 of guide base 16.

Cementing of the 13⅜ inch casing only cements the shoe and lower part of the 13⅜ inch casing (see FIG. 1) so that there is a free pathway down to the foot of the casing for slurry injection (see also FIG. 1).

It may be desirable to place a differential valve (DV) in the 13⅜ inch casing at the base of the porous formation into which the slurry is to be injected. A differential valve is a known type of valve formed of a sliding sleeve which can be opened or shut by dropping a plug down the casing. The use of a differential valve allows the annulus to bs flushed removing any cement and cuttings in it and ensuring that there is a clear path for injection of slurry into the porous formation.

Once the 13⅜ inch hanger and casing have been fully installed and cemented into place they are sealed and locked down at the well head as shown in FIG. 8. At this stage the slurry injection system may be flushed with water to ensure that there will be a clear flow of slurry into the porous formation 22, using flexible line 20 (FIG. 2) or line 57 and stab 58 on BOP package 83 as shown in FIG. 8.

Either way, with BOP package 83 in place and drill string 81 lowered, drilling can resume and injection of slurry or any other fluid to be disposed of can now take place at any time. It can be simultaneous with further drilling or at any subsequent time during which the guide base remains in place The oil-impregnated cuttings disposed of in this way can be from the well being drilled or from any other adjacent well.

The arrows of FIG. 8 show the disposal of oil-impregnated cuttings simultaneously with drilling. Oil based drilling mud shown passing down the inside of drill string 81 and back up inside the 13⅜ inch casing 79 to the drilling rig via a riser. On the drilling rig, the cuttings can be separated from the drilling mud using a system shown diagramatically in FIG. 9.

Figure 9:
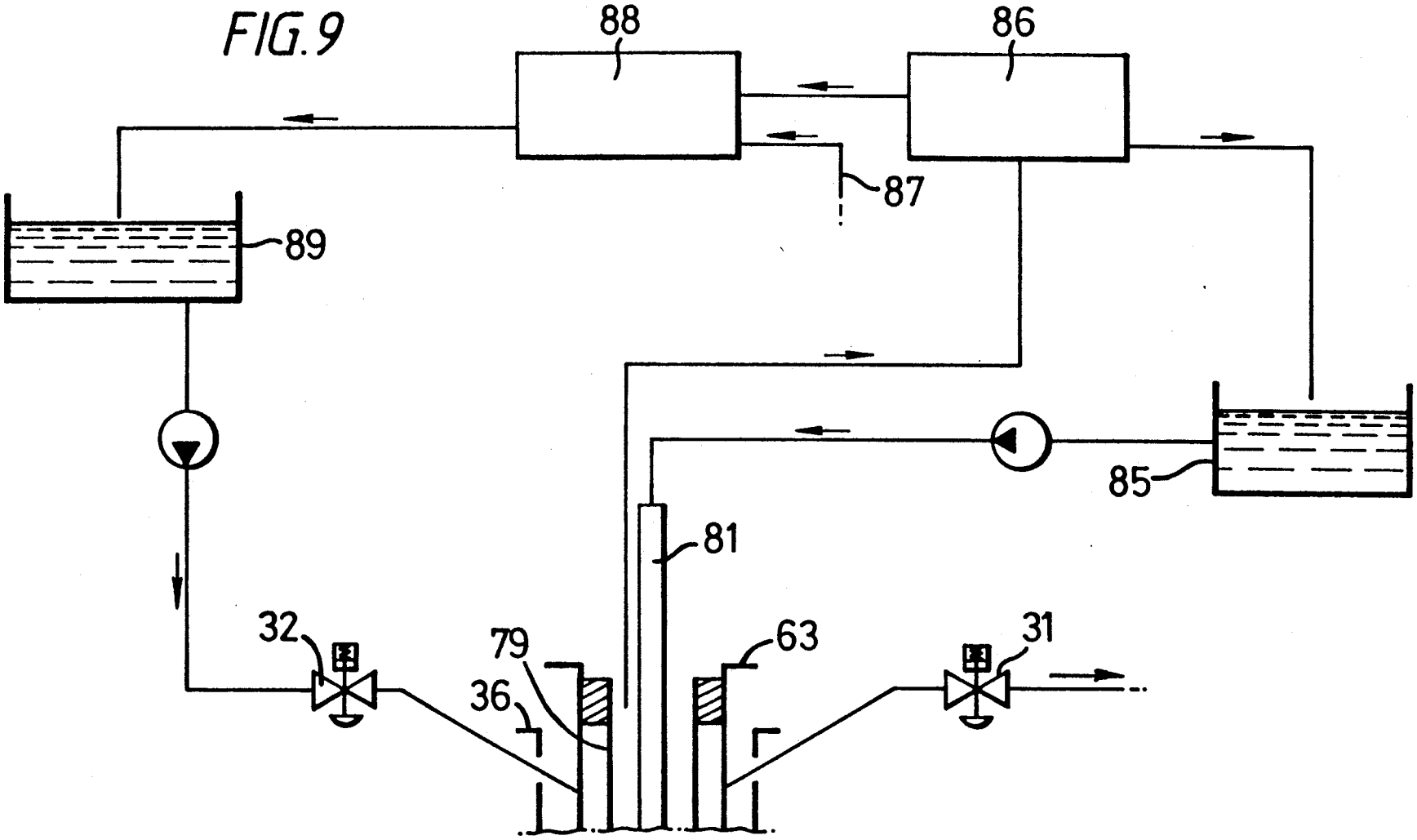
FIG. 9 is a flow diagram of a drill cuttings separation and reinjection system on a drilling rig.

In FIG. 9 oil based drilling mud from storage tank 85 is pumped to drill string 81. Oil based mud plus drilled cuttings coming up a riser from 13⅜ inch casing 79 are fed to separator 86. Oil based drilling mud minus the cuttings is returned to storage tank 85. The cuttings together with salt water from line 87 are fed to a crusher 88 and thence to slurry storage tank 89. The slurry of ground cuttings in salt water is then pumped either through flexible line 20 and swivel coupling 34 (FIGS. 1 to 3) or through injection line 57, stab 58 and female receptacle 50 (FIG. 8) to slurry injection valve 32.

The arrows of FIG. 8 show how the slurry of ground cuttings is passed through valve 32, receptacle 48, pipe 46, port 44, port 43, check valve 66 and port 67 to the annulus between 20 inch casing 11 and 13⅜ inch casing 79 and so down to the formation into which the slurry is to bs injected.

Although FIG. 9 shows cuttings from a contemporaneous drilling operation being re-injected, as previously stated, the cuttings to be injected may come from any source and be fed to crusher 88 at any time.

Eventually, when no further disposal of cuttings is required, the annulus is sealed off by cement pumped into the well down the slurry injection system (any surplus being flushed out by opening the cement dump valve and washing through the lines). The retrievable portion of the guide base can then be recovered and it and its slurry injection system used on another well.

If the slurry injection system uses a flexible pipe and swivel coupling, the system is independent of any operation connected with drilling itself or any drilling units such as BOP stacks and risers. Its use only depends on the employment of a suitably engineered guide base. If the slurry injection system uses a pipe on a BOP package then, obviously, the BOP package must be in place to operate the injection system. Nevertheless, by making the injection system operate through a base rather than the well head proper, the system still has considerable flexibility and will allow injection at any time that the BOP package and guide base are in place.

I claim:

1. Apparatus for injecting unwanted slurries or fluids resulting from drilling or other operations into an annulus of a sub-sea well, being surrounded by a drilling guide base positioned on an underwater surface and having an outer well head housing and casing, the pathway for the injection being through the guide base and outer housing without modification of the well head housing proper, said pathway comprising:

pipework on the guide base leading to a port in the outer well housing, a fail safe isolation valve on the guide base joined to the pipework, and a coupling on the guide base joined to the fail safe isolation valve to which a line from a surface vessel or platform can be attached.

2. Apparatus as claimed in claim 1 wherein the sub-sea well has a further well head housing and casing inside the outer well head housing and casing, said further housing having a port adjacent to the port in the outer housing.

3. Apparatus as claimed in claim 2 wherein the further housing also has a one-way check valve.

4. Apparatus as claimed in claim 3 wherein the check valve comprises a cylinder with ports and a cylindrical sleeve with ports sliding within the cylinder.

5. Apparatus as claimed in claim 4 wherein the check valve has seals sealing the ports against leakage along the sliding surfaces of the cylinder and cylindrical sleeve, the seals being positioned at a distance from the ports at least equal to the diameter of the ports so that when the valve closes the flow of fluid through the valve is cut off before any of the seals have to cross the ports.

6. Apparatus as claimed in claim 2 wherein the line is a flexible line and the coupling a swivel coupling.

7. Apparatus as claimed in claim 2 wherein the line is a rigid line down a riser to a BOP package, the BOP package extending the line down to the coupling on the guide base.

8. Apparatus as claimed in claim 7 wherein the line on the BOP package terminates in a stab adapted to mate with a female receptacle on the guide base to form the coupling.

9. Apparatus as claimed in claim 2 wherein the guide base is a retrievable guide base formed of an inner annular portion fixed to the outermost housing and a retrievable outer portion releasably locked to the inner portion.

10. Apparatus as claimed in claim 9 wherein the pipework is on the inner annular portion and the isolation valve and coupling are on the retrievable outer portion.

11. Apparatus as claimed in claim 10 wherein the pipework and the isolation valve and coupling are releasably connected by a stab and female receptacle.

12. Apparatus as claimed in claim 10 wherein the guide base also has a cement circulation system, said system comprising pipework leading from the well outside the outer casing and a cement dump valve joined to the pipework.

* * * * *